United States Patent [19]

Roos et al.

[11] Patent Number: 4,712,412

[45] Date of Patent: Dec. 15, 1987

[54] DRAWING APPARATUS IN PRESSES

[75] Inventors: Gerhard Roos, Ebersbach; Hartmut Dexling, Gingen; Wolfgang Michael, Goeppingen, all of Fed. Rep. of Germany

[73] Assignee: L. Schuler GmbH, Goeppingen, Fed. Rep. of Germany

[21] Appl. No.: 828,173

[22] Filed: Feb. 11, 1986

[30] Foreign Application Priority Data

Feb. 21, 1985 [DE] Fed. Rep. of Germany ..... 3505984

[51] Int. Cl.[4] ..... B21D 24/02

[52] U.S. Cl. ..... 72/345; 72/453.13; 267/119

[58] Field of Search ..... 72/344, 345, 347, 350, 72/351, 453.13, 427; 267/119

[56] References Cited

U.S. PATENT DOCUMENTS

| | | | |
|---|---|---|---|
| 1,503,105 | 7/1924 | Balcker | 72/453.13 |
| 1,846,439 | 2/1932 | Rode et al. | 267/119 |
| 2,300,162 | 10/1942 | Maude | 267/119 |
| 2,989,019 | 6/1961 | Van Sciver | 72/351 |
| 3,456,478 | 7/1969 | Alexander | 72/351 |

*Primary Examiner*—Lowell A. Larson

*Attorney, Agent, or Firm*—Barnes & Thornburg

[57] ABSTRACT

A drawing apparatus, by means of which the different individual functions such as control of the sheet metal holder pressure, control of the sheet metal holder upward movement, control of the ejector movement and of the end position abutment are adjustable, respectively, controllable independently of one another. In a drawing apparatus with pressure cylinders (8) for the sheet metal retention during the drawing and with pressure cylinders (9) for the ejection of the workpieces, with a pressure cheek (1) guided in the press table and movable and supported by the pressure cylinders (8, 9) and with a follower control installation (48) acting in the lower dead-center position on a pressure cylinder (8) effecting the sheet metal retention during the drawing operation, the pressure cylinders (8, 9) are thereby held fixed at the press; the piston rods (6) of the pressure cylinders (8, 9) effecting the sheet metal retention are adapted to be placed in the direction (14) of the sheet metal retaining pressure against the pressure cheek (1) and one follower control installation (48, 49) is coordinated to each pressure cylinder (8) effecting the sheet metal retention and to each pressure cylinder (9) effecting the ejection; with the use of several pressure cylinders (9) for the ejections, one follower control installation each is connected thereto, possibly one follower control installation common to all such pressure cylinders may be used.

20 Claims, 1 Drawing Figure

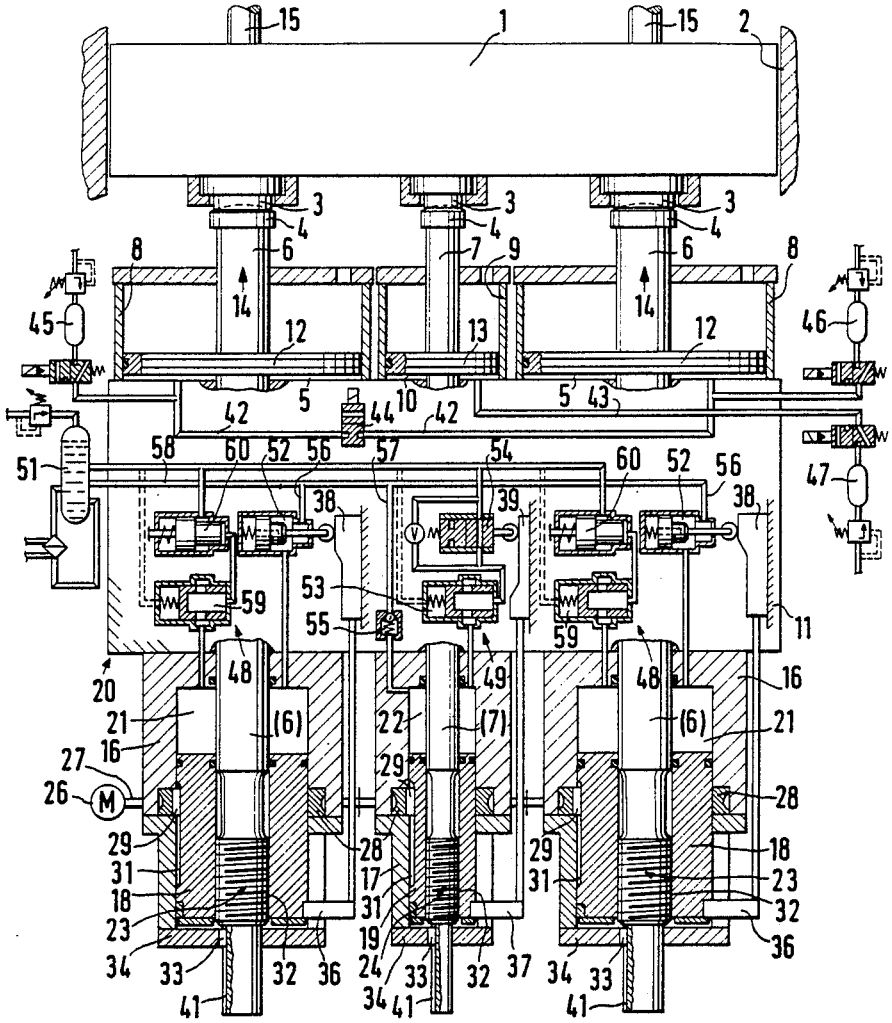
15
1
15
2
3
4
6
7
9
8
14
45
46
12
13
5
10
43
42
44
51
58
60
52
56
57
54
38
39
47
53
55
59
11
20
48
49
16
21
(6)
22
(7)
27
26
M
29
28
18
31
23
17
19
24
32
34
33
36
37
41

DRAWING APPARATUS IN PRESSES

The present invention relates to a drawing apparatus in presses, with pressure cylinders for the sheet metal retention during the drawing and with pressure cylinders for the ejection of the workpieces, with a supported pressure cheek guided in the press table and movable and supported by the pressure cylinders and with a follower control installation acting in the lower dead-center position on a pressure cylinder effecting the sheet metal retention during the drawing operation.

Drawing apparatus serve for the production of the sheet metal retention force during the sheet metal deformation (drawing) and for the production of the ejection movement (lifting) of the shaped workpiece in presses and transfer presses. Drawing apparatus include a pressure cheek which during the displacement of the press ram into the lower dead-center position—end area of the deformation—is displaced by way of pressure rods while producing the sheet metal retention force and follows the movement of the ram into the upper dead-center position—the area remote from the work tool—while taking along the shaped workpiece. The force of the drawing apparatus, while the pressure cheek follows the movement of the ram into the upper dead-center position, is approximately equal to the sheet metal retention force during the workpiece deformation. Consequently, the workpieces are pressed during the ejection against the upper part of the work tool by the pressure rods and may therefore be deformed.

In the installation according to the DE-OS No. 27 42 405, a drawing apparatus is used for avoiding the deformation of the workpieces with a pressure cheek which trails or lags controlled behind the movement of the ram into the upper dead-center position thereof. The press ram thereby presses the pressure cheek into the lower dead-center position as with the noncontrolled drawing operation. Upon reaching the lower dead-center position, a hydraulic blocking mechanism is actuated which permits to the pressure cheek together with the workpiece to follow with a delay the movement of the ram into the upper dead-center position. The next deformation operation—renewed displacement of the press ram in to the lower dead-center position—can take place only after the workpiece removal and the insertion of a new sheet metal blank so that a small output quota results with drawing apparatus of this type.

For increasing the output quota, the DE-PS No. 32 02 134 provides a drawing apparatus in which the drawing force is separated from the ejection force. After the deformation of the sheet metal blank, the ejector follows with a smaller force the movement of the ram corresponding to a smaller displaced volume in the ejection cylinders whereas the pressure cylinder for the drawing function is initially prevented by a follower control installation from a movement following the movement of the ram into the upper dead-center position. Several ejection cylinders are disposed on a displaceable pressure cheek. The workpiece is brought into the removal position with the velocity of the ram return movement. For preventing undesired movements of the workpiece out of the lower part of the work tool, other measures are required such as, for example, smoothing and damping pins installed in the work tool upper part.

In contrast thereto, the present invention is concerned with the task to provide a drawing apparatus in which the individual functions—control of the sheet metal holder-(drawing)-pressure, control of the sheet metal holder upward movement, control of the ejector (lifting) upward movement and control of the end position abutment—are adjustable, respectively, controllable independently of one another.

The underlying problems are solved according to the present invention in that the pressure cylinders effecting the sheet metal retention and the ejection are held fixed at the press, in that the piston rods of the pressure cylinders effecting the sheet metal retention are adapted to be placed against the pressure cheek in the direction of the sheet metal holder pressure, and in that one follower control installation each is coordinated to and operatively connected with each of the pressure cylinders effecting the sheet metal retention and the pressure cylinder effecting the ejection and with the use of several pressure cylinders for the ejection, one follower control installation each, possibly one follower control installation common to all, is operatively connected with the several pressure cylinders.

The coupling of workpiece and drawing apparatus takes place only by gravity by way of the sheet metal holder, the pressure rods and the pressure cheek. The drawing apparatus of this invention enables according to the design a delay of the upward movement of the pressure cheek, respectively, of the pressure rods for the ejection of less than 1 g. The residual abutment velocity is adjustable to values below 0.1 m/sec so that the workpieces can be seized by the workpiece transfer mechanism in the standstill thereof directly upon completed ejection movement. The adjusting measures of the individual functions do not mutually influence one another. Thus, also the pressure in the individual support points of the sheet metal holder are adjustable so as to be different from one another. The arrangement of the pressure cylinders and of the auxiliary cylinders on a common bracket fixed at the press and the lifting (disengagement) of the pressure cheek for the ejection from the piston rods effecting the sheet metal retention during the drawing serve the improved ejection of the workpieces and the good adjustability of the drawing and ejection operations. The drawing operation is fully automatically adjustable to different workpiece shapes and thicknesses of the sheet metal blanks. The arrangement of the components of the follower control installations into function blocks and into the areas near the cylinders avoids any movable pressure lines of large cross section and therebeyond creates shorter flow paths and shorter shifting periods.

Further particular advantages of the present invention reside in that the upward movement of the pressure cylinders for the sheet metal retention takes place at a constant velocity and the upward stroke of the ejector operation takes place velocitycontrolled independently of the adjusted sheet metal holder force with a constant small force. The control variations produce low-loss end position dampings (slight throttle losses). Further significant advantages result from the, for example, three-phase controlled ejector operation in that during the ejector movement the force transmission between the pressure cheek, the pressure rods and the workpiece to the ram is discontinued. The ejector velocity is controllable with an ejector force that stays constant.

These and other objects, features and advantages of the present invention will become more apparent from the following description when taken in conjunction with the accompanying drawing which shows, for purposes of illustration only, one embodiment in accordance with the present invention, and wherein:

The single FIGURE is a somewhat schematic view, partly in cross section, of a drawing apparatus in presses in accordance with the present invention.

The drawing apparatus illustrated in the drawing for purposes of illustration only, includes in its construction a pressure cheek 1 which is movable in slide guidances 2. The slide guidances 2 are located at the pressure cheek 1 as well as in the table of a press, of a stage press and the like with, for example, of a drawing station for deforming flat sheet-metal blanks. The pressure rods 15 indicated above the pressure cheek 1 transmit the sheet metal retaining force and the ejector movement onto the work tool lower part resting on the press table. The pressure cheek 1 is supported in the direction of the arrows 14 by way of piston rods 6 and 7 as well as by way of ball sockets 3 and part-spherical members 4 installed between the pressure cheek 1 and the piston rods 6 and 7. The piston rods 6 are disengageable from the bottom side of the pressure cheek 1, and the pressure cheek 1 is adapted to be raised without the same into a raised position (upper dead-center position) which corresponds to the removal position for the workpieces. The piston rods 6 and 7 are coordinated to pressure cylinders 8 and 9, to pistons 12 and 13 movable in the same and to auxiliary cylinders 16 and 17 as well as to pistons 18 and 19 movable in the auxiliary cylinders 16 and 17. The pressure cylinders 8 and 9 are installed above a press-fixed bracket 11—fastened in the press table. The auxiliary cylinders 16 and 17 are installed underneath the bracket 11 and coaxially to the coordinated pressure cylinders 8 and 9. The piston rods 6 and 7 are also extended out of the respective pressure cylinder 8 and 9 at the bottom side thereof and are guided through the bracket 11 and the associated auxiliary cylinders 16 and 17. The bracket 11 receives the control block generally designated by reference numeral 20 to be described more fully hereinafter for the follower control installations generally designated by reference numerals 48 and 49. In the illustration of the bracket 11, the showing of the follower control installations 48 and 49 has priority. The pistons 18 and 19 displaceable in the auxiliary cylinders 16 and 17 are adjustably supported in the direction of the longitudinal axis of the piston rods 6 and 7 by way of a displacement thread at a threaded extension 32 in the end part 23 and 24 of the piston rods 6 and 7. One worm gear 28 each is mounted rotatably but axially nondisplaceably with respect to the piston rods 6 and 7 in the walls of each auxiliary cylinder 16 and 17, whereby each worm gear 28 is operatively connected with one of the pistons 18 and 19 by way of an adjusting or spline spring 29 and a longtiudinal groove 31 in such a manner that with a rotation of a rotating shaft 27 and the worm (not shown) secured at the same by an adjusting motor 26, the axial position of the pistons 18 and 19 in the auxiliary cylinders 16 and 17 is adjusted in relation to the piston rods 6 and 7 in order to so adjust the end position of the piston rods 6 and 7 with respect to their upper dead-center position. An adjusting member 36 and 37 is taken along with the pistons 18 and 19 in the direction of the movement of the piston rods 6 and 7. The adjusting members 36 and 37 are connected with mechanically actuatable valves 52 and 54 by way of control cams 38 and 39 and are guided in the bracket 11 within the area of their control cams 38 and 39—indicated schematically by cross-hatched surface sections. The piston rods 6 and 7 are secured against rotation by way of adjusting or spline springs 33 retained in the cylinder covers 34 and guided in longitudinal grooves 41 of the end parts 23 and 24 of the piston rods 6 and 7.

During the downward movement of the pressure cheek 1 as a consequence of the deformation movement of the press ram, the volumes of the pressure spaces 5 and 10 underneath the piston 12 and 13 in the pressure cylinders 8 and 9 are reduced and the precompressed air present thereat is displaced by way of lines 42 and 43 into the interconnected pressure-adjusted pressure gas containers or vessels 45, 46 and 47. The volumes of the pressure spaces 21 and 22 above the pistons 18 and 19 in the auxiliary cylinders 16 and 17 become larger during the downward movement of the pressure cheek 1 and are filled by way of lines 56, 57 and 58 and by way of the check valves 52 and 55 from a hydraulic reservoir 51 which may possibly be pneumatically prestressed. The check valves 52 are constructed as mechanically unlockable valves. The force necessary for the sheet metal retention during the drawing operation is to be applied in the pressure cylinder 8 and in part also in the pressure cylinder 9 by way of the pressure gas containers or vessels 45, 46 and 47 adjusted to an appropriate supply pressure. The pressure in the pressure gas containers or vessels 45, 46 and 47 and in the pressure spaces 5 and 10 in the absence of any follower control would lead to the direct following on the part of the pressure cheek 1 of the press ram when moved back into the upper dead-center position.

Follower control installations 48 and 49 are operatively connected with the pressure cylinders 8 and 9 by way of the pressure spaces 21 and 22 of the auxiliary cylinders 16 and 17 which effect an upward movement of the piston rods 6 and 7 into the upper dead-center position time-delayed to the displacement of the ram. As a result of the different design (equipment) of the follower control installations 48 and 49, a separation of the (lifter) ejector operation by means of the pressure in the pressure space 10 of the pressure cylinder 9 is possible from the upward movment of the pressure cylinders 8 effecting for the largest part the sheet metal retention. A control throttle 53 which is adjusted in its cross section under the secondary pressure of the valve 54 (adjusting throttle) mechanically opening by way of the control valve cam (39), is interconnected into the return flow of hydraulic fluid from the pressure space 22 of the auxiliary cylinder 17 to the hydraulic reservoir 51. The secondary pressure of the control throttle 53 is adjusted by the control throttle 54 corresponding to the movement of the piston 19 taking place by way of the control cam 39. The pressure can be adjusted, for example, in three steps by corresponding design of the cam shape so that different flow cross sections and therewith different large flow quantities can be controlled with this two-way flow control. Thus, for example, the ejector force and velocity is possible in the first phase with small throttle losses by means of the net output force of the pressure gas vessel 47. With corresponding design of the control elements, the second phase can effect a pressure build up counteracting the pressure in the pressure space 10 which leads to the termination of the force transmission between the pressure cheek 1, the pressure rods 15, ejector parts of the work tool and the pressure ram. The third phase can be so constructed and designed that the workpiece is brought with a delay into the removal position (transport plane) at a constant pressure by the further closing of the adjusting throttle 54 and therefore by the increased secondary pressure at the control throttle 53, which corresponds to a value smaller than 1 g. The control throttle 53 and adjusting throttle 54 form in their illustrated and functional construction a two-path flow control.

A two-path flow control consisting of a control throttle 59 and of an adjusting throttle 60 connected in series therewith is connected in the return flow of hydraulic fluid from the pressure spaces 21 of the auxiliary cylinders 16 to the common hydraulic reservoir 51, by means of which the upward movement of the piston rods 6 is controllable (regulatable) under the air pressure stored in the pressure gas vessels 45 and 46. The instant of time of the start of the control is adjustable by way of the check valve 52 actuated by the control cam 38. Thus, different variations result for the upward movement of the piston rods 6.

A shifting valve 44 is connected in the line 42, by means of which the pressure circuits of the individual pressure cylinders 8 which produce the drawing force, can be separated from one another. By way of differently large air pressures in the pressure gas vessels 45 and 46, the drawing counter-holding force is thus variable in the individual drawing ranges of a sheet metal holder on the work tool side and is thus adjustable to the drawing conditions.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. Drawing apparatus for presses having a system for resisting the amount of press force and ejecting a work piece comprising:

first pressure piston-cylinder means for resisting the amount of press force; second pressure piston-cylinder means for ejecting the work piece; pressure cheek means displaceably guided in a press table in response to the press force to an end position and supported by said first and second pressure piston-cylinder means;

said first and second pressure cylinder means having one of a cylinder or piston portions thereof, fixedly mounted at said pressure table; where, upon release of said press force a first follower means causes a non-fixed portion of the second pressure piston-cylinder means to displace the cheek means in a direction opposite to said displacement caused by said press force and with a non-fixed portion of said first pressure piston-cylinder means being disconnected from and no longer supporting the cheek means.

2. A drawing apparatus according to claim 1 wherein a second follower means causes the non-fixed portion of the first pressure piston-cylinder means to be displaced to again support the cheek means subsequent to release of the press force and the displacement of the cheek means by the non-fixed portion of the second pressure piston-cylinder means.

3. A drawing apparatus according to claim 2, wherein fluid pressure control means are provided for controlling the pressure in said first and second pressure piston-cylinder means.

4. A drawing apparatus according to claim 3, wherein said follower means comprises auxiliary first and second pressure piston-cylinder means; said auxiliary pressure piston-cylinder means having one of the cylinder or piston portions secured to said pressure table and the non-secured portion connected to the non-fixed portion of the first and second pressure piston-cylinder means; and control means for controlling the pressure in said auxiliary first and second pressure piston cylinder means.

5. A drawing apparatus according to claim 4, wherein the control means for the auxiliary piston-cylinder means comprises a first and second follower element means fixedly attached to the respective movable portions of said first or second auxiliary piston cylinder means.

6. A drawing apparatus according to claim 3, wherein there are plural first pressure piston-cylinder means and the control means for controlling the pressure to the first pressure piston-cylinder means comprises valving means which can provide for the same or different fluid pressures in respective plural said first pressure piston-cylinder means.

7. A drawing apparatus according to claim 2, wherein said follower means comprises auxiliary first and second pressure piston-cylinder means; said auxiliary pressure piston-cylinder means having one of the cylinder or piston portions secured to said pressure table and the non-secured portion connected to the non-fixed portion of the first and second pressure piston-cylinder means; and control means for controlling the pressure in said auxiliary first and second pressure piston cylinder means.

8. A drawing apparatus according to claim 7, wherein the control means for the auxiliary piston-cylinder means comprises a first and seocnd follower element means fixedly attached to the respective movable portions of said first or second auxiliary piston cylinder means.

9. A drawing apparatus according to claim 8 wherein an adjustment means is provided to adjust the position of the first and second follower elements with respect to their respective movable portions of the auxiliary pressure piston-cylinder means.

10. A drawing apparatus according to claim 8, wherein the control means for controlling the pressures in both said first and second auxiliary pressure piston-cylinder means is connected to the single source of fluid pressure and wherein each follower element actuates valving means to control flow of pressure from said source to each of said auxiliary respective plural pressure piston-cylinder means.

11. A drawing apparatus according to claim 1, wherein fluid pressure control means are provided for controlling the pressure in said first and second pressure piston-cylinder means.

12. A drawing apparatus according to claim 11, wherein said follower means comprises auxiliary first and second pressure piston-cylinder means; said auxiliary pressure piston-cylinder means having one of the cylinder or piston portions secured to said pressure table and the non-secured portion connected to the non-fixed portion of the first and second pressure piston-cylinder means; and control means for controlling the pressure in said auxiliary first and second pressure piston cylinder means.

13. A drawing apparatus according to claim 12, wherein the control means for the auxiliary piston-cylinder means comprises a first and second follower element means fixedly attached to the respective movable portions of said first or second auxiliary piston cylinder means.

14. A drawing apparatus according to claim 13 wherein an adjustment means is provided to adjust the position of the first and second follower elements with respect to their respective movable portions of the auxiliary pressure piston-cylinder means.

15. A drawing apparatus according to claim 11, wherein there are plural first pressure piston-cylinder means and the control means for controlling the pressure to the first pressure piston-cylinder means comprises valving means which can provide for the same or different fluid pressures in said respective plural first pressure piston-cylinder means.

16. A drawing apparatus according to claim 1, wherein said follower means comprises auxiliary first and second pressure piston-cylinder means; said auxiliary pressure piston-cylinder means having one of the cylinder or piston portions secured to said pressure table and the non-secured portion connected to the non-fixed portion of the first and second pressure piston-cylinder means; and control means for controlling the pressure in said auxiliary first and second pressure piston cylinder means.

17. A drawing apparatus according to claim 16, wherein the control means for the auxiliary piston-cylinder means comprises a first and second follower element means fixedly attached to the respective movable portions of said first or second auxiliary piston cylinder means.

18. A drawing apparatus according to claim 17 wherein and adjustment means is provided to adjust the position of the first and second follower elements with respect to their respective movable portions of the auxiliary pressure piston-cylinder means.

19. A drawing apparatus according to claim 17 wherein an adjustment means is provided to adjust the position of the first and second follower elements with respect to their respective movable portions of the auxiliary pressure piston-cylinder means.

20. A drawing apparatus according to claim 17, wherein the control means for controlling the pressures in both said first and second auxiliary pressure piston-cylinder means is connected to the single source of fluid pressure and wherein each follower element actuates valving means to control flow of pressure from said source to each of said auxiliary respective plural pressure piston-cylinder means.

* * * * *